US005284300A

United States Patent [19]

Gries et al.

[11] Patent Number: 5,284,300

[45] Date of Patent: Feb. 8, 1994

[54] PORTABLE SPRAY SYSTEM

[75] Inventors: Ronald E. Gries; Aaron D. Gries; Andrew S. Gries, all of Perrysburg, Ohio

[73] Assignees: Jon Brown; Greg Dickerson; John Naylor, Perrysburg, Ohio

[21] Appl. No.: 932,074

[22] Filed: Aug. 19, 1992

[51] Int. Cl.[5] ..... B05B 9/04

[52] U.S. Cl. ..... 239/373; 239/152; 239/327; 141/2; 141/21

[58] Field of Search ..... 239/152, 153, 154, 373, 239/375, 327, 304, 526; 141/2, 18, 21, 67

[56] References Cited

U.S. PATENT DOCUMENTS

| | | | |
|---|---|---|---|
| 1,902,548 | 3/1933 | Fenwick, Jr. | 239/153 |
| 2,137,786 | 11/1938 | Schlosser | 239/375 |
| 2,991,945 | 7/1961 | Rosenkranz | 239/526 |
| 3,260,463 | 7/1966 | Giovansanti et al. | 239/373 |
| 3,343,804 | 9/1967 | Pinke | 239/152 |
| 3,721,299 | 3/1973 | Roessler | 239/154 |
| 4,782,982 | 11/1988 | Ellison | 239/373 |
| 5,115,947 | 5/1992 | McDonnell et al. | 141/18 |

*Primary Examiner*—Andres Kashnikow
*Assistant Examiner*—Christopher G. Trainor
*Attorney, Agent, or Firm*—Marshall & Melhorn

[57] ABSTRACT

A portable spray system is provided with a plurality of storage containers for receipt and storage of pressurized water from a residential water tap. A manifold connects the storage containers to a segment of hose. The opposite end of the hose is connected to a standard spray nozzle which includes a trigger handle and a threaded discharge end. The water stored in the portable containers and the pressure to pressurize the system are received simultaneously from a standard residential water tap. The only component required for filling and pressurizing the containers is a short filling hose segment having a threaded female connector at each end. To prepare the water spray system for operation, one end of the filling hose is connected to a water tap and the other end of the filling hose is connected to the threaded discharge end of the spray nozzle. The spray nozzle is opened and the water tap is turned on which permits water to flow into the storage bottles. The bottles are filled with water under pressure. The final step in preparing for operation is to close the spray nozzle, turn off the water tap, and disconnect the filling hose segment from the spray nozzle. The water stored under pressure in the portable containers may then be discharged by squeezing the trigger handle to open the nozzle.

10 Claims, 2 Drawing Sheets

PORTABLE SPRAY SYSTEM

BACKGROUND OF THE INVENTION

1. Field of the Invention

The invention relates generally to a system for storing and spraying liquids, and in particular, to a low cost, recreational spray system which stores water and other liquids under pressure such that the water may be sprayed from the system by operation of a nozzle.

2. Summary of Related Art

Recreational and toy devices for spraying water are well known. Nearly everyone has used a squirt gun or other device to spray water at some time during their youth. In addition to recreational applications, portable spray devices are used for numerous commercial applications.

A number of different techniques are used to spray a liquid from a storage container. The simplest toy devices typically include a pumping device in a reservoir of liquid such that the liquid is sprayed from a discharge tube when a trigger is operated.

In other devices, a liquid is stored under pressure and then is sprayed when a nozzle or other relief mechanism is actuated to spray the liquid. The pressure in the storage containers is generally supplied by a hand pump or other external pressure source.

In today's recreational market place, the use of larger and more powerful squirt guns has been observed. The volume of water stored and sprayed by such large squirt guns and the distance covered by the spray have increased significantly.

SUMMARY OF THE INVENTION

The present invention relates to a portable spray system that is simple to operate, inexpensive and easy to construct, and capable of spraying a relatively high volume of water for a significant distance.

In accordance with the present invention, there is provided a portable spray system having a plurality of portable storage containers. The containers are mounted on a frame or a back pack device. A manifold connects the storage containers to a segment of hose. The opposite end of the hose is connected to a standard spray nozzle which includes a trigger handle and a threaded discharge end.

The water stored in the portable containers and the pressure to pressurize the system are received simultaneously from a standard residential water tap. The only component required for filling and pressurizing the containers is a short filling hose segment having a female garden hose connector at each end. To prepare the water spray system for operation, one end of the filling hose is connected to a water tap and the other end of the filling hose is connected to the threaded discharge end of the spray nozzle. The spray nozzle is opened and the water tap is turned on which permits water to flow into the storage bottles. The bottles are filled with water under pressure. The final step in preparing for operation is to close the spray nozzle, turn off the water tap, and disconnect the filling hose segment from the spray nozzle.

The water stored under pressure in the portable containers may then be discharged by squeezing the trigger handle to open the nozzle. Once the pressure has dropped such that no additional water is being discharged, the storage containers may be refilled from the water tap for continued use of the water spray system.

An object of the present invention is to provide a low cost spray system that is inexpensive to manufacture and simple to use. The components of the water spray system are fairly standard items which are combined in a unique and novel fashion.

An additional object of the present invention is to provide a water spray system that is fun to use because of the performance of the system. The present invention can spray more water a greater distance than most recreational spray guns.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
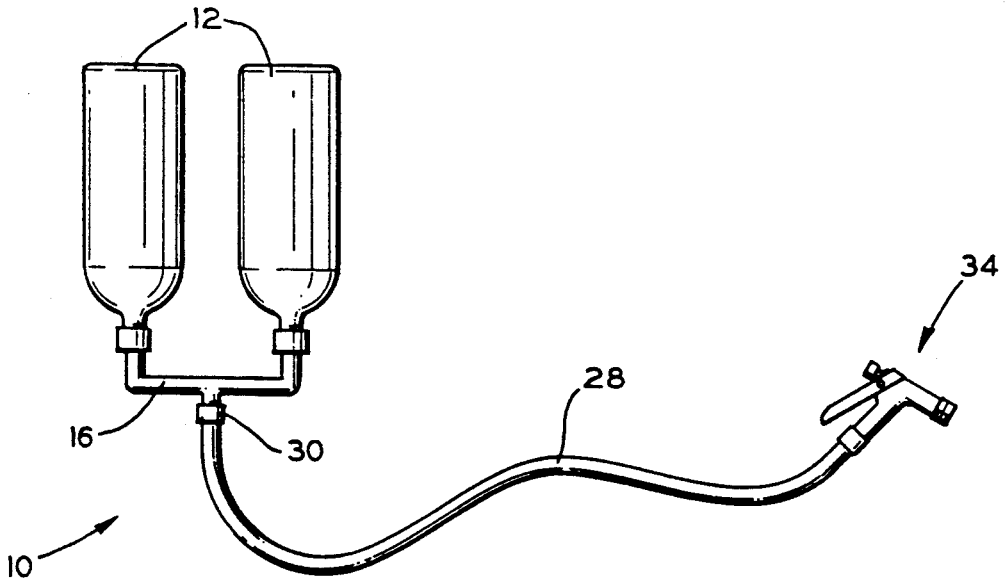
FIG. 1 is a perspective view of the spray system of the present invention.
Figure 2:
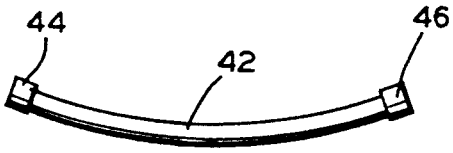
FIG. 2 shows the filler hole segment used to fill and pressurize the system shown in FIG. 1.

Referring now to the drawings, there is shown in FIGS. 1 and 2 the portable water spraying system 10 of the present invention.

The storage containers 12 are used to store water or other liquids under pressure. The containers 12 for storing the liquid may be one large container or may include two or more smaller containers as shown in FIG. 1. Two three-liter containers are typically the best size for the system 10 when considering storage capacity, weight balancing, and spraying capabilities.

The storage containers 12 may be made of any material suitable for storing water. Plastic containers, such as the two-liter or three-liter plastic bottles used for soft drinks, provide a light weight, low cost storage container 12. Other household containers with a threaded opening may be used or containers may be custom built for this system 10.

Figure 3:
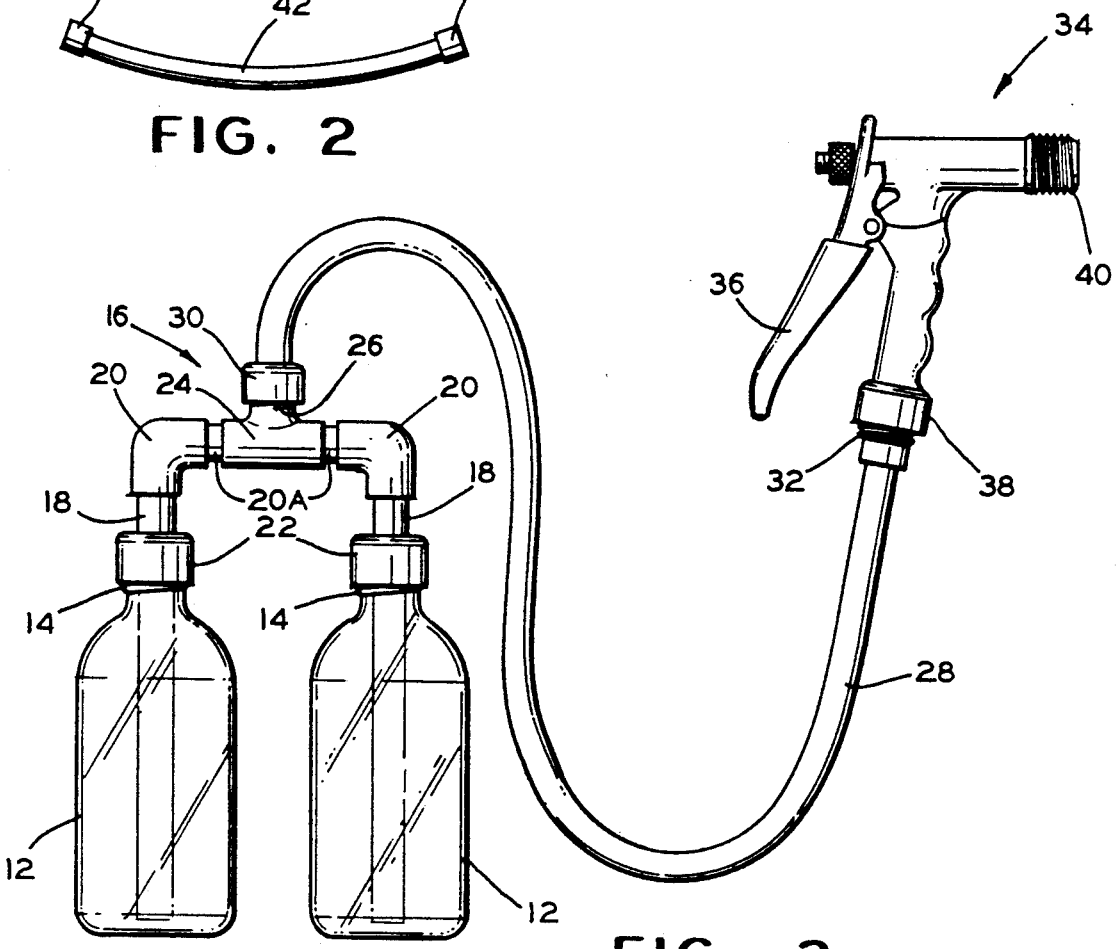
FIG. 3 is a elevational view of the spray system shown in FIG. 1.

FIG. 3 shows an elevational view of the primary components of the water spraying system 10. At the top of the water storage container 12, a threaded opening 14 is used to connect the storage containers 12 to the manifold 16. The manifold 16 is made from standard polyvinyl chloride (PVC) pipe or other similar pipe material. The manifold 16 may be formed from a single piece of PVC pipe or assembled from standard residential PVC components as shown in FIG. 3. The manifold 16 of the present invention includes a tubular element 18 inserted into and extending from each of the storage containers 12. The tubular elements 18 are then connected by elbows 20 and straight pieces 20A to the T-connector 24. A threaded coupling 22 mounted on the tubular element 18 is rotatably connected to the threaded opening 14 to close and seal the opening 14 of the container 12. The connections to the elbow 20 and T-connector 24 are sealed by a standard epoxy seal for PVC pipe. The coupling 22 may be omitted from the tubular element 18, in which case the gap between the tubular element 18 and the opening 14 may be sealed by an epoxy seal or other similar means for sealing the gap.

The construction of the manifold 16 can be modified to accommodate a variety of storage container 12 arrangement for the system. If only one container is used, the tubular element and a straight adapter (not shown) may be used.

A segment of hose 28 is then connected to the input-output port 26 of manifold 16. The hose segment 28 includes a standard female connector 30 for threadably connecting the hose 28 to the input-output port 26. The other end of the hose 28 includes a standard male connector 32. The length and diameter of the hose segment 28 may be selected to achieve the desired performance of the system 10. Since the hose segment 28 is used for both filling and spraying water from the containers 12, the diameter of the hose 28 will affect the time requirements and performance capabilities of the system 10. Generally, a hose 28 of three to six feet in length provides the user with enough flexibility to properly direct the stream of water from the water spraying system 10.

The male end 32 of the hose segment 28 is connected to a standard trigger-handle spray nozzle 34. The valve inside the spray nozzle 34 is operated by compressing and releasing the trigger-handle 36. The input port 38 for the spray nozzle 34 is a standard female connector which is threaded onto the male end 32 of the hose segment 28. The output port 40 for the spray nozzle 34 includes a standard threaded male connector as shown in FIG. 3.

The final component of the water spray system 10 is the filler hose 42, which is only used when filling the water storage containers 12. As shown in FIG. 2, the filler hose 42 is a short piece of hose, typically two to four inches in length. The filler hose 42 includes female connectors 44 and 46 at opposite ends of the filler hose 42.

Figure 4:
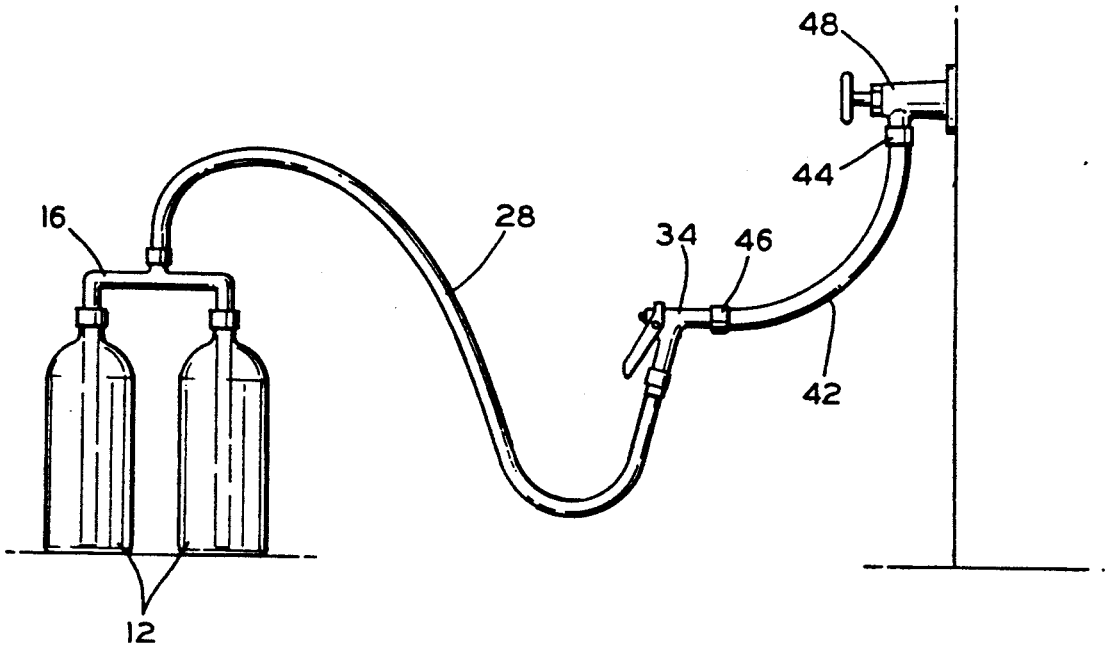
FIG. 4 shows the spray system of FIG. 1 connected to an outdoor residential water tap through the filler hole segment of FIG. 2.

The first step in using the system 10 is to tighten all of the threaded connections of the manifold 16 and hose 28 to eliminate any pressure loss as the containers 12 are filled with water and pressurized. FIG. 4 shows the simple procedure for filling and pressurizing the containers 12, in which the filler hose 42 has one female connector 44 attached to a standard residential outdoor water tap 48 and the other female connector 46 attached to the male output port 40 of the spray nozzle 34. The trigger handle 36 of the spray nozzle 34 is compressed to open the valve of the spray nozzle 34. The water tap 48 is then opened to permit water to flow from the water tap 48 through the filler hose 42, the spray nozzle 34, the hose segment 28, and the manifold 16 into the storage containers 12.

The typical residential water supply will have an approximate tap pressure of 45 pounds per square inch. All of the connections from the tap 48 to the water storage containers 12 must be tight enough to prevent air and water leaks. Because the water tap pressure is greater than the air pressure (atmospheric pressure) inside the storage containers 12, water from the tap 48 will be forced into the storage containers 12. Air inside the containers 12 will be compressed as water enters the container.

Once the pressure in the containers 12 equals the water tap pressure, water will cease to flow into the containers 12. Although the containers 12 will not be totally filled, the capacity of the system has been reached for a specific water tap 48. To determine when the containers 12 are filled to capacity, the water flow can be observed if the containers 12 are transparent. If the containers 12 are not transparent, the user can listen for the sound of water flowing into the containers 12.

After the storage containers 12 are filled, the trigger handle 36 on the spray nozzle 34 is released to close the spray nozzle valve. This maintains the desired water pressure in the system 10. The water tap 48 is then shut off and the filler hose 42 is disconnected from both the spray nozzle 34. The spray system 10 is now ready for use. When the trigger handle 36 is squeezed, the water in the storage containers 12, which is under pressure, sprays out of the output port 40.

Figure 5:
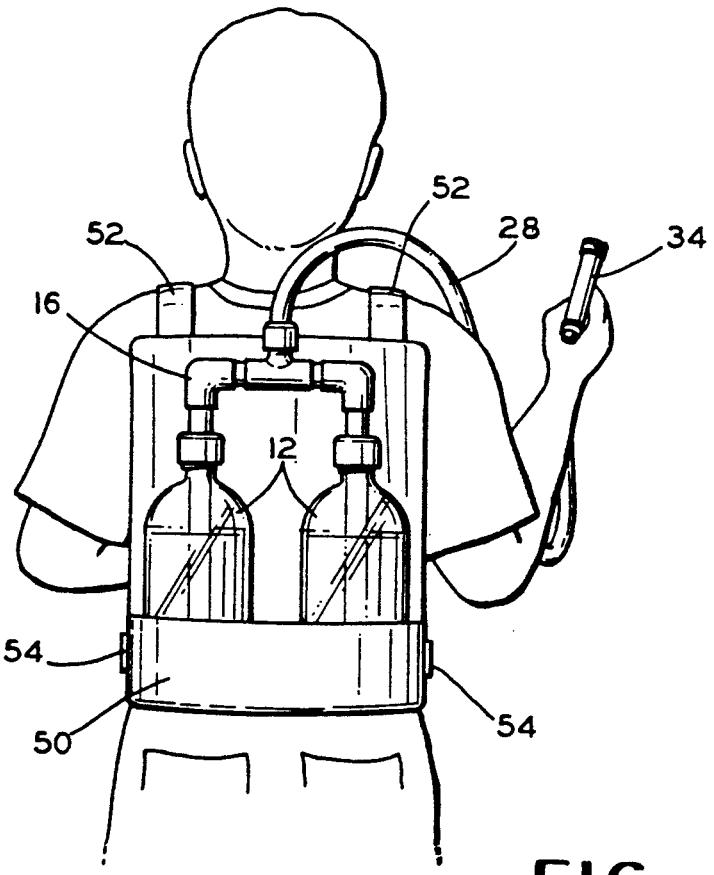
FIG. 5 shows the system installed on a back pack and mounted on an individual for use.

FIG. 5 shows the spray system 10 mounted on a back pack frame 50 for use by an individual user. A wide variety of frames or other carrying systems could be used in making the system portable. If only one container is used, the storage container 12 could be carried in a hip holster, for example. The back pack frame 50 may include shoulder straps 52 and a waist belt 54 to secure the system 10 to the back of the user.

Once the back pack 50 is mounted on the user, all the necessary functions for operation can be performed without removing the back pack 50. To fill the system 10, the user simply draws the hose segment 28 around his side or over his shoulder to easily connect the spray nozzle 34 to the filler hose 42.

In FIGS. 3-5, the system 10 is shown with the threaded opening 14 on the container 12 at the top, which necessitates the use of the tubular elements 18 extending to the bottom of the container 12 to achieve the proper pressurization of the system. The system 10 could also be positioned with the containers 12 inverted and the threaded opening 14 at the bottom of the system 10. In the inverted position, the tubular elements 18 can be shortened to extend just inside the threaded 22. The procedures for filling and operating the system 10 remain the same.

In addition to each of this spray system 10 for recreational purposes, the system may also be used for various commercial applications. The system may be used for applying lawn and garden treatments. This portable system would permit the user to take water or any other liquid from a pressurized system, store the liquid under pressure, and then release the pressure to spray the liquid at a desired target.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A portable spray system comprising:

a) storage means for storing a fluid, said storage means including at least one plastic container having an aperture;

b) a trigger nozzle provided with a first orifice and a first connector at a first end of said trigger nozzle, and a second orifice and a male connector at a second end of said trigger nozzle to facilitate two-way fluid communication through said trigger nozzle; and c) communication means for providing fluid communication between said storage means and said trigger nozzle, said communication means having a first hose connector on a first end for connection to the aperture of said storage means, and said communication means having a second hose connector on a second end for connection to the first connector of said trigger nozzle;

d) a transfer hose having a female connector at each end, a first of said female connectors for selectively connecting said transfer hose to the male connector of said trigger nozzle, and a second of said female connectors for selectively connecting said transfer hose to a source of pressurized fluid, whereby said transfer hose is connected to the source of pressurized fluid and said trigger nozzle for supplying pressurized fluid from the source to said storage means, and whereby said transfer hose is disconnected from said trigger nozzle for spraying pressurized fluid from said storage means through said trigger nozzle.

2. The portable spray system defined in claim 1 wherein said storage means includes a plurality of plastic containers, each of said containers having a said aperture, and a manifold connected to the apertures on said plurality of plastic containers.

3. The portable spray system defined in claim 1 wherein said storage means has a fluid capacity of at least six liters.

4. The portable spray system defined in claim 2 wherein the manifold is made of polyvinyl chloride pipes.

5. The portable spray system defined in claim 4 wherein the manifold includes a tubular element extending into each of said plastic containers.

6. The portable spray system defined in claim 1 wherein said communication means includes a flexible hose in fluid communication between said storage means and said trigger nozzle.

7. The portable spray system defined in claim 1 wherein the source of pressurized fluid is a residential water tap and the second female connector on said transfer hose is a threaded female connector.

8. The portable spray system defined in claim 1 wherein said storage means includes a carrier means for carrying the storage means on the back of an individual.

9. A portable spray system comprising:

a) a plurality of plastic containers, each of said containers having a threaded aperture;

b) means for carrying said plurality of plastic containers;

c) a polyvinyl chloride manifold connected to the apertures of said plastic containers;

d) a flexible hose having a first end connected to said manifold;

e) a trigger nozzle provided with a threaded male connector on one end and a female connector on the other end for connection to a second end of said flexible hose; and f) a transfer hose having a first end selectively connected to a conventional water tap and a second end selectively connected to the threaded male connector of said trigger nozzle, whereby said transfer hose is connected to the water tap and said trigger nozzle for supplying pressurized water from the water tap to said plurality of plastic containers, and whereby said transfer hose is disconnected from said trigger nozzle for spraying pressurized water from said plurality of plastic containers through said trigger nozzle.

10. A system for converting a plurality of household containers for liquids into a portable sprayer utilizing water furnished from a residential water tap, said system comprising:

a) means for carrying the containers;

b) a manifold provided with a plurality of ports for connection to an aperture of the containers;

c) a tubular extension for providing fluid communication between said manifold and a bottom of the containers;

d) a flexible hose connected to said manifold;

e) a trigger nozzle provided with a female connector on the one end for connection to said flexible hose and a threaded male connector on the other end; and f) a transfer hose provided with an end for connection to the water tap and a second end for selective connection to the male connector on said trigger nozzle, whereby pressurized water is supplied to and stored in said containers until said transfer tube is disconnected from said spray nozzle and said trigger nozzle is opened to spray the water.

* * * * *